US006885919B1

(12) United States Patent
Wyant et al.

(10) Patent No.: US 6,885,919 B1
(45) Date of Patent: Apr. 26, 2005

(54) METHOD FOR CONTROLLING THE OPERATION OF A MARINE VESSEL

(75) Inventors: John W. Wyant, Fond du Lac, WI (US); Phillip K. Gaynor, Fond du Lac, WI (US); Kurt D. Willows, West Bend, WI (US); Michael J. Lemancik, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/452,181

(22) Filed: Jun. 2, 2003

(51) Int. Cl.[7] ..... B63H 21/21

(52) U.S. Cl. ..... 701/21; 701/29; 701/123; 701/201; 340/450.2; 440/1; 440/2

(58) Field of Search ..... 701/21, 29, 123, 701/201, 207, 213; 440/1, 2; 340/450.2

(56) References Cited

U.S. PATENT DOCUMENTS

| | | | | | |
|---|---|---|---|---|---|
| 4,939,660 | A | * | 7/1990 | Newman et al. | 701/123 |
| 5,301,113 | A | * | 4/1994 | To et al. | 701/123 |
| 5,355,140 | A | | 10/1994 | Slavin et al. | 342/386 |
| 5,386,368 | A | | 1/1995 | Knight | 364/432 |
| 5,491,636 | A | | 2/1996 | Robertson et al. | 364/432 |
| 5,506,564 | A | * | 4/1996 | Hargest | 340/450.2 |
| 5,731,788 | A | | 3/1998 | Reeds | 342/357 |
| 5,884,213 | A | | 3/1999 | Carlson | 701/206 |
| 6,709,302 | B2 | * | 3/2004 | Yanagihara | 440/1 |
| 2003/0082963 | A1 | * | 5/2003 | Motose et al. | 440/2 |
| 2003/0109184 | A1 | * | 6/2003 | Kanno | 440/1 |

* cited by examiner

*Primary Examiner*—Michael J. Zanelli
*Assistant Examiner*—Eric M. Gibson
(74) *Attorney, Agent, or Firm*—William D. Lanyi

(57) ABSTRACT

A process is provided by which the operator of a marine vessel can invoke the operation of a computer program that investigates various alternatives that can improve the range of the marine vessel. The distance between the current location of the marine vessel and a desired waypoint is determined and compared to a range of the marine vessel which is determined as a function of available fuel, vessel speed, fuel usage rate, and engine speed. The computer program investigates the results that would be achieved, theoretically, from a change in engine speed. Both increases and decreases in engine speed are reviewed and additional theoretical ranges are calculated as a function of those new engine speeds. The operator of the marine vessel is informed when an advantageous change in engine speed is determined.

23 Claims, 5 Drawing Sheets

METHOD FOR CONTROLLING THE OPERATION OF A MARINE VESSEL

BACKGROUND OF THE INVENTION

1. Field of the Invention

The present invention is generally related to a method for controlling the operation of a marine vessel and, more particularly, to a method that monitors both the current position of a marine vessel and a planned waypoint, along with several other variables, to determine whether the vessel has sufficient fuel to reach the planned waypoint. The method for controlling the marine vessel can be automatic or can comprise suggesting certain control changes (e.g. engine speed) to an operator of the vessel.

2. Description of the Prior Art

Many systems are available for determining the location of a marine vessel or other type of vehicle. Marine vessels are typically provided with various sensors that also monitor the current status of operational variables relating to the marine vessel. For example, modern watercraft are usually provided with sensors that measure the engine speed (RPM), vessel speed (MPH), available fuel in a fuel tank (gallons), and various other parameters. Using a global positioning system (GPS), the current location of the marine vessel can be accurately determined. By comparing sequential GPS locations as a function of time, the speed of the marine vessel can be accurately calculated. In addition, the distance between a desired waypoint and the current position of the marine vessel can be calculated.

U.S. Pat. No. 5,355,140, which issued to Slavin et al on Oct. 11, 1994, describes an emergency reporting system for marine and airborne vessels.

The method and apparatus are disclosed for reporting an emergency event experienced by a marine vessel, an airborne vessel or by an occupant of the vessel. The present vessel position, accurate to within a few tens of meters, and the vessel velocity and local air quality is determined at an ordered sequence of times, using a position-determining Global Positioning System, such as the Navstar system or the GLONASS system. If an emergency occurs on the vessel, the approximate present position and time of occurrence of this event is broadcast on one or more of the mobile communication or emergency radio wave bands. Optionally, the type of emergency event that has occurred drawn from a predetermined list of such types, is also broadcast by a vessel in distress, for receipt by an emergency response facility or by another vessel that can respond to a call for assistance. Optionally, the vessel velocity heading and/or vessel position quality of fixed information is also broadcast by a vessel in distress.

U.S. Pat. No. 5,491,636, which issued to Robertson on Feb. 13, 1996, describes an anchorless boat positioning process employing global positioning systems. An anchorless boat positioning system dynamically and automatically maintains a boat at a selected anchoring location within water without the use of a conventional anchor by using a steerable thruster whose thrust and steering direction are determined on the basis of position information signals received from global positioning system (GPS) satellites and heading indication signals from a magnetic compass. The anchorless positioning system continuously monitors the position and heading of the boat and compares it with the stored coordinates of the selected anchoring location to generate control signals for a steerable motor.

U.S. Pat. No. 5,731,788, which issued to Reeds on Mar. 24, 1998, describes a global positioning and communications system and a method for race and start line management. A system and method for positioning control and management of racing sailboat positions and velocities includes the strategic placement of global positioning receivers and transmitters at a buoy and committee boat marking the sail race start line, as well as radio and global positioning receivers on the sailboat. Global positioning system (GPS) and radio transmitter units are mounted on a race start buoy and committee boat and another GPS and radio transceiver unit receives GPS signals from positioning satellites and radio signals from the race start buoy and committee boat. The information received by the racing sailboat is processed to determine relative and absolute positions and velocities, and estimated time of arrival (ETA) at the intercept between current sailboat course and race start line for display in user-friendly race management.

U.S. Pat. No. 5,386,368, which issued to Knight on Jan. 31, 1995, so describes an apparatus for maintaining a boat in a fixed position. An apparatus for maintaining a floating boat or water vessel in a desired position is provided. The apparatus includes an electric trolling motor disposed to produce a thrust to pull the boat, a steering motor disposed to affect the orientation of the electric trolling motor, a position deviation detection unit, and a control circuit. The position deviation detection unit detects a deviation in the position of the boat from the desired position and transmits signals indicative of a deviation distance (the distance from the boat to the desired position) and a return heading (the direction of the desired position from the boat) to a control circuit. The control circuit causes the steering motor to steer the electric trolling motor in the return heading, and the electric trolling motor to propel the boat in the return heading, to return the boat to the desired position.

U.S. Pat. No. 5,884,213, which issued to Carlson on Mar. 16, 1999, describes a system for controlling navigation of a fishing boat. A system for controlling the navigation of a fishing boat between waypoints representing successive positions around a navigation route is described. The system includes an input device for setting the waypoint positions, a position detector to detect the actual position of the fishing boat, a trolling motor to produce a thrust to propel the fishing boat, a steering motor to control the direction of the thrust, and a heading detector to detect the actual heading of the fishing boat. The system also includes a control circuit which determines a desired heading using a desired waypoint and the actual position of the fishing boat, and generates a steering control signal applied to the steering motor to steer the fishing boat from the actual position to the desired waypoint. The system operates in various modes which allow repeated navigation of the fishing boat around a navigation route. The system provides for automatic waypoint storage as the fishing boat is maneuvered around navigation route.

It would be significantly beneficial for the operation of a marine vessel if a system could be provided that determine whether or not the marine vessel has sufficient fuel onboard to allow it to travel along a planned course to a desired waypoint. In one typical application, such a system would be used to assure that the marine vessel has sufficient fuel to return to its home port after the marine vessel has journeyed away from the home port on a body of water.

The patents described above are hereby expressly incorporated by reference in the description of the present invention.

SUMMARY OF THE INVENTION

A method for controlling the operation of a marine vessel, made in accordance with the preferred embodiment of the present invention, comprises the steps of determining several variables such as a quantity of available fuel of the marine vessel, a velocity of the vessel, a current operating speed of an engine of the marine vessel, and a first rate of fuel consumption of the vessel. The present invention further determines a theoretical range available to the marine vessel as a function of the quantity of available fuel, the velocity, and the rate of fuel consumption. It also determines a current location of the marine vessel and allows the selection, typically by the operator of the marine vessel, of a desired or planned future location or waypoint. The present invention determines the distance between the current location and the desired location and compares the theoretical range to the distance.

In a preferred embodiment, the present invention determines if the range is less than the distance. In situations where the distance is greater than the range, the present invention determines if a change of the current operating speed of the engine will increase the range to a magnitude which is greater than the distance. In a preferred embodiment, the present invention determines whether an increase or a decrease of the current operating speed of the engine will increase the range to a magnitude which is greater than the distance. The system informs the operator of the marine vessel that a change of the current operating speed of the engine will increase the range to the magnitude which is greater than the distance, if this type of change is determined to be effective. In certain embodiments of the present invention, the current operating speed of the engine can be automatically increased or decreased to increase the range of the marine vessel to a magnitude greater than the distance. In other embodiments of the present invention, the operator of the marine vessel is informed of the suggested change in the operating speed of the engine and the change is suggested to the operator for manual implementation.

In a typical application of the present invention, the current operating speed of the engine is measured in revolutions per minute (RPM), the velocity is measured in distance per unit of time, and the available fuel is measured in gallons. In certain embodiments, the present invention can provide an annunciated message to inform the operator when the range is less than the distance. Also, in certain alternative embodiments of the present invention, the magnitudes of the distance and the range can be continually monitored and the system can provide an alarm notification to the operator of the marine vessel when the magnitude of the distance is greater than a preselected percentage (e.g. 90%) of the magnitude of the calculated range. The current location can be determined by a Global Positioning System which can also be used to calculate the velocity of the marine vessel. The velocity of the marine vessel can also be determined by a paddle wheel sensor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
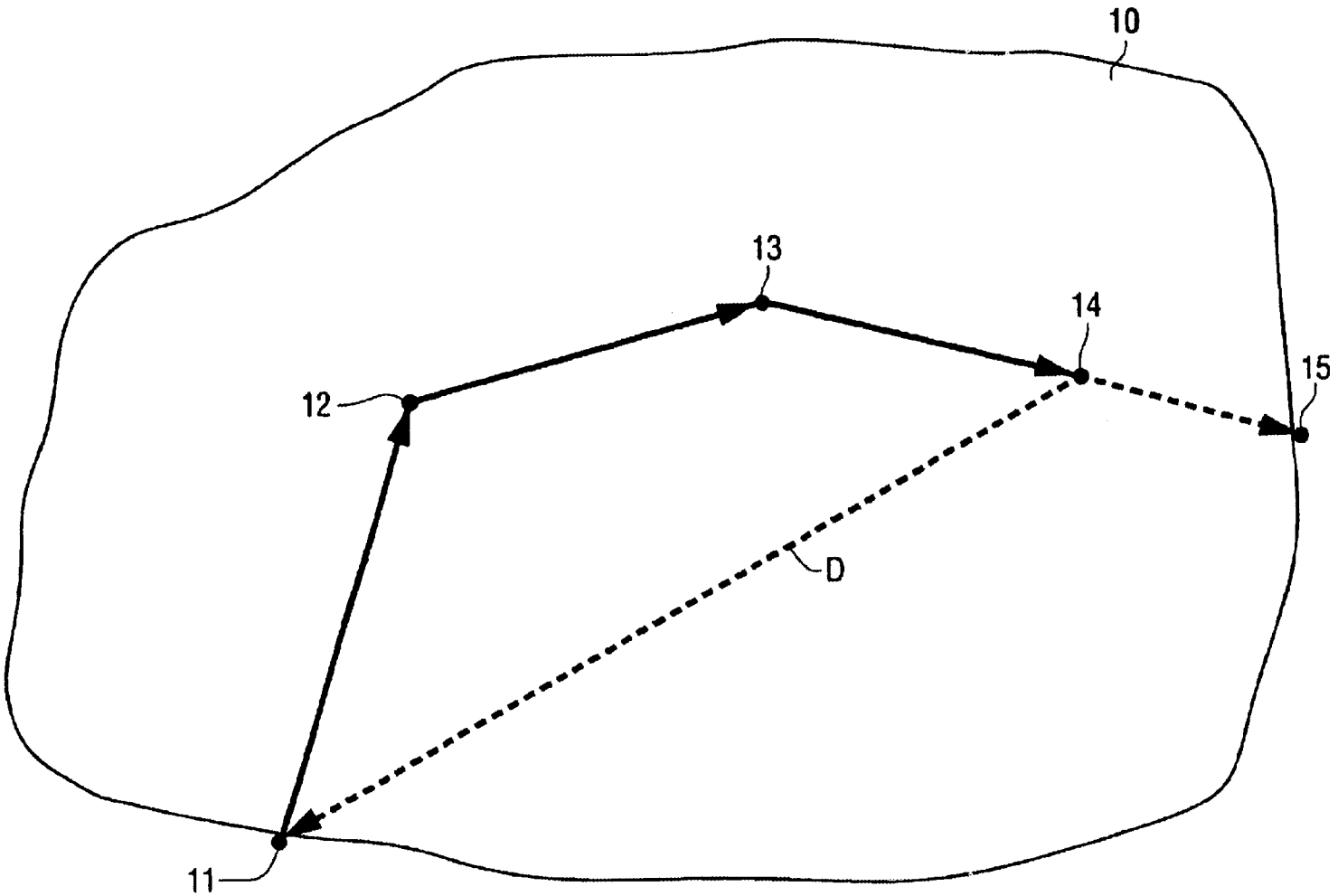
FIG. 1 is an exemplary representation of an itinerary of a marine vessel.

Throughout the description of the preferred embodiment of the present invention, like components will be identified by like reference numerals.

FIG. 1 is a highly schematic representation of a body of water 10 with various waypoints identified. The body of water 10 can be a freshwater lake. However, the present invention can also be particularly helpful when the operator of a marine vessel is traveling offshore.

In the exemplary illustration of FIG. 1, a first waypoint 11 represents a home port of a marine vessel. The waypoints identified by reference numerals 12–14 represent successive waypoints during an exemplary journey of a marine vessel. The primary purpose of the present invention is to assist the operator of a marine vessel in circumstances where the ability of the marine vessel, as a function of remaining fuel, to return to the desired waypoint 11 is in doubt. This circumstance can arise when the operator of the marine vessel does not vigilantly monitor the current location of the marine vessel with respect to the home port 11 and the amount of remaining fuel onboard. As will be described in greater detail below, the present invention can be used in any one of several ways. For example, the operator of the marine vessel can manually invoke the operation of the present invention when it is discovered, such as at waypoint 14, that the ability to return to the desired waypoint 11 may be in doubt. Alternatively, the present invention can be invoked to operate continuously to monitor the changing positions of the marine vessel with respect to the homeport 11 and continuously determine the ability of the marine vessel to return to the desire waypoint 11 based on the amount of fuel on the vessel and the rate of fuel usage.

Figure 2:
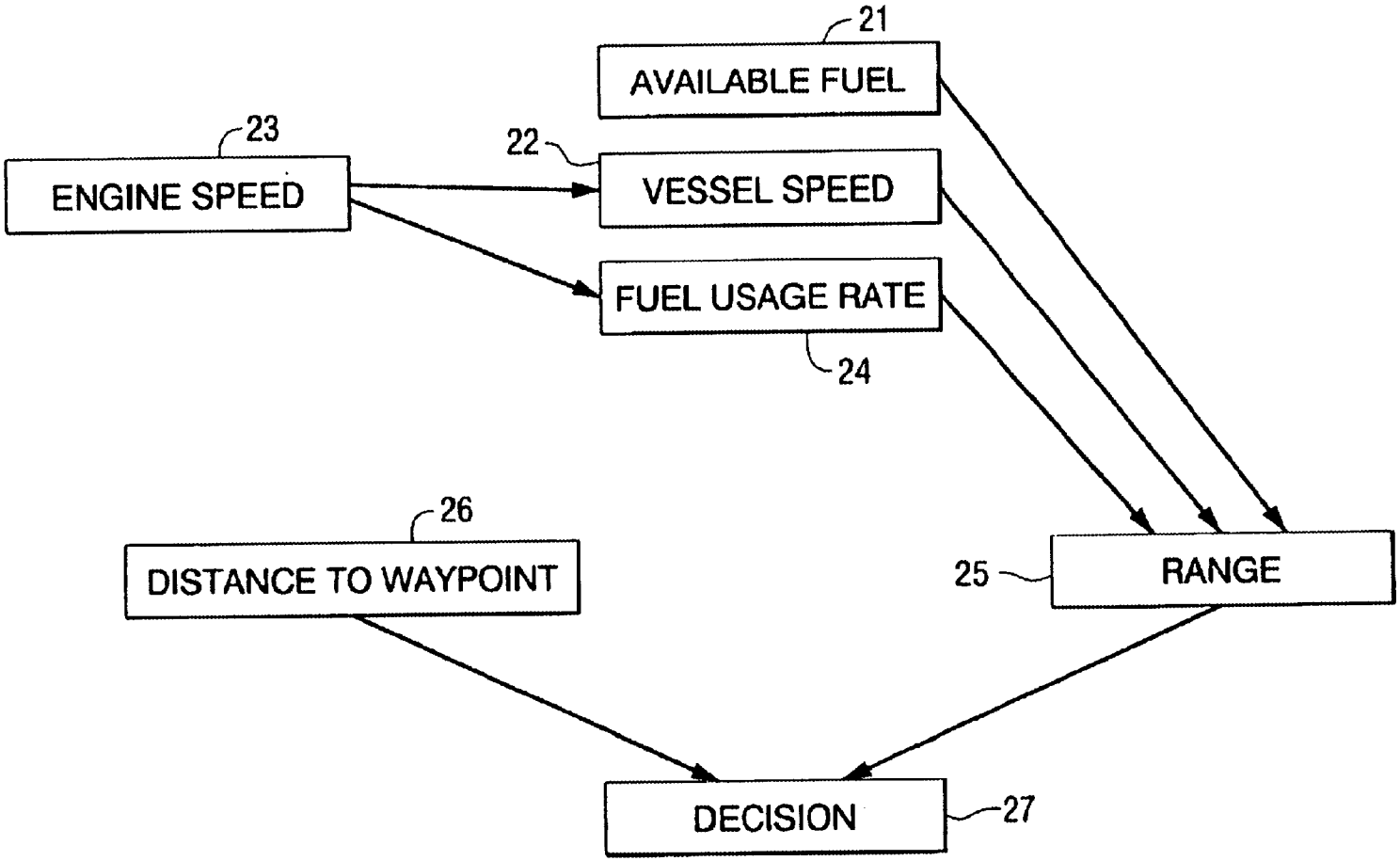
FIG. 2 shows various parameters that are used by the present invention to determine whether a change in engine speed will achieve a desired improvement in the range of the vessel.

An exemplary use of the present invention will be described in conjunction with FIGS. 1 and 2 for a situation in which the marine vessel is located at waypoint 14 in FIG. 1 when the operator of that marine vessel determines that the ability to return to the desired waypoint 11 may be in question. FIG. 2 shows several parameters that the present invention uses or calculates in order to perform its function of assisting the operator of the marine vessel to return to the desired waypoint 11 from the current waypoint 14.

With reference to FIGS. 1 and 2, the present invention determines a quantity of available fuel of the marine vessel as identified by block 21 in FIG. 2. This determination can be made in one of several ways. First, a fuel level sensor located within the fuel tank can provide a signal, in a manner well to those skilled in the art, representing the depth of fuel in the tank. That depth signal can be converted to a quantity of fuel, such as gallons. The present invention also determines the velocity of the vessel, as represented by block 22. The marine vessel speed, measured in distance per unit of time, can be determined in several ways. Speed over ground (SOG) can be determined through the use of a Global Positioning System (GPS) which periodically determines the precise global position of the marine vessel, monitors changes in position of the vessel, and determines the rate of change in position as a function of time. The speed of the vessel can also be determined through the use of more conventional speedometers, such as paddle wheels and pitot tubes, which measure speed over water (SOW). Although the differences may be minimal, it is preferable to use a marine vessel speed magnitude that is determined as a speed over ground (SOG).

With continued reference to FIGS. 1 and 2, the current operating speed of the marine vessel is determined, as represented by block 23 in FIG. 2, by a tachometer. The engine speed, measured in revolutions per minute, is important because it affects both vessel speed 22 and fuel usage rate 24. Although vessel speed 22 is not solely determined by engine speed 23, because of the effects of load, it is generally closely related to the vessel speed when operating in the planing region of the vessel. The fuel usage rate can also be changed by changing the engine speed 23. The fuel usage rate 24 can be determined relatively easily, particularly in engine systems that utilize fuel injection. When the fuel injection system is controlled by a microprocessor, such as an engine control module (ECM), each activation of the fuel injection system causes a preselected amount of fuel to be injected by the fueling system. These injections can be accumulated by the microprocessor to determine an accurate fuel usage rate. In addition, the fuel usage rate for various engine operating speeds can be determined either by a calibration process or during the normal use of the marine vessel. For example, as the operator of the marine vessel uses the vessel, the engine control module can easily determine the engine operating speed and the fuel usage rate and store those parameters for later reference. By doing this, the fuel usage rates for various engine speeds can be later referenced by the present invention during its determination of appropriate engine speeds for use in maximizing the range of the marine vessel during its trip back to the desired waypoint 11.

By knowing the available fuel 21, the vessel speed 22, and the fuel usage rate 24, the present invention determines a theoretical range 25 of the marine vessel. In other words, at the current engine speed 23, the available fuel 21 will allow the marine vessel to operate at the vessel speed 22 for a period of time that determines the range 25.

The present invention also determines a current location of the marine vessel, such as waypoint 14, through the use of a global positioning system (GPS). This desired location is selected by the operator of the marine vessel. In this example relating to FIG. 1, the desired location is waypoint 11 which represents a satisfactory return of the marine vessel to its home port. However, it should be understood that the desired waypoint could be a subsequent waypoint on a journey which is intended as the destination of the marine vessel. Since the current location 14 is known and the desired location 11 has been selected, the distance D between the current location 14 and desired location 11 can be determined. This distance D to the waypoint is identified by block 26 in FIG. 2. The distance D to the waypoint and the range 25 are both known and can be compared to each other. This allows the present invention to make a decision at block 27 of FIG. 2 regarding the likelihood that the marine vessel will be able to return to the desired waypoint 11 based on the known parameters.

Figure 3:
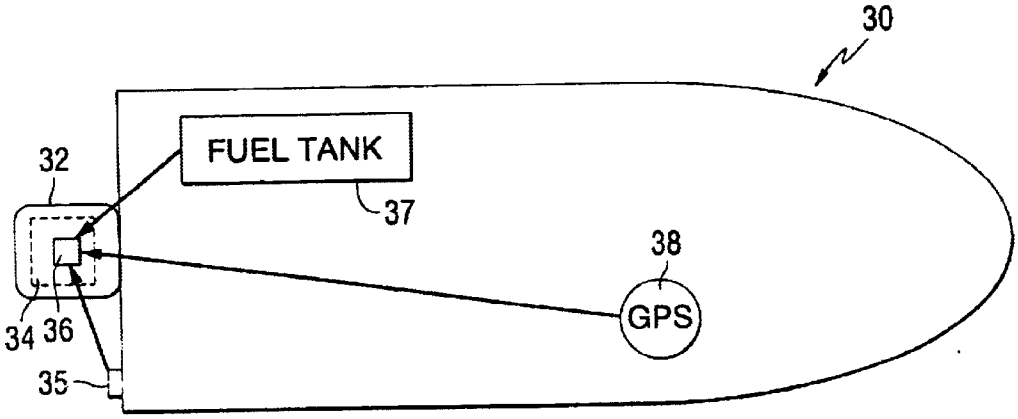
FIG. 3 is a schematic representation of a marine vessel with the necessary components to perform the present invention.

In order to perform the steps of the process of the present invention, various parameters must be determined regarding the conditions relating to the marine vessel. These parameters are easily determined by devices that are commercially available and are well known to those skilled in the art. FIG. 3 represents a marine vessel 30 and FIG. 4 is a schematic representation of certain components used to monitor the parameters necessary to perform the method of the present invention.

In FIG. 3, the marine vessel 30 is illustrated as being propelled by an outboard motor 32. The outboard motor 32 has an internal combustion engine 34. An engine control module 36 is provided to control the operation of the engine 34. A fuel tank 37 stores a quantity of fuel for use by the engine 34. A global positioning system 38 is provided to identify the position of the marine vessel 30 and determine certain variables, such as vessel speed.

Figure 4:
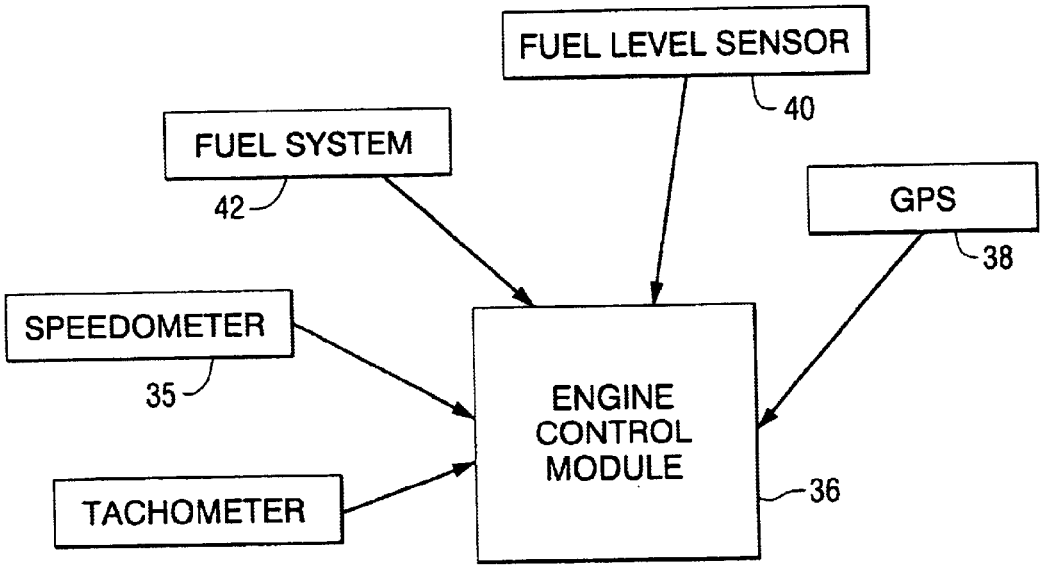
FIG. 4 is a block diagram showing several sensors used in the performance of the present invention.

FIG. 4 is a block diagram showing various parameters monitored by the engine control module 36. A fuel level sensor 40 provides information relating to the quantity of fuel remaining in the fuel tank 37. The fuel system 42, in certain fuel injected engines, comprises a microprocessor which is able to accumulate the number of fuel injection events and the amount of fuel injected during each of those events. Therefore, the fuel system 42 shown in FIG. 4 can provide the fuel usage rate 24 described above in conjunction with FIG. 2. In FIG. 4, the GPS 38 is also shown. A conventional speedometer 35, as represented at the transom of the marine vessel 30 in FIG. 3 and as a input in FIG. 4 to the engine control module 36, can be either a paddle wheel speedometer or a pitot tube. It should be understood that a conventional speedometer 35 is not a requirement for operation of the present invention. The information relating to vessel speed can be obtained directly from the GPS 38.

A significant advantage provided by the present invention is that it is able to suggest, or implement, changes in engine speed 23 which will change the range 25 of the marine vessel 30. In other words, if the marine vessel is being operated at an engine speed that is less than optimal, in terms of fuel economy, the present invention suggests changes in the engine speed that can either be implemented manually by the operator of the marine vessel 30 or, in certain embodiments of the present invention, directly by the engine control module 36.

After determining if the range 25 is less than the distance D, shown in FIG. 1, the present invention determines if a change of the current operating speed of the engine will increase the range of the marine vessel to a magnitude which is greater than the distance D. As will be described in greater detail below, the present invention determines if an increase or a decrease in the current operating speed of the engine will increase the theoretical range 25 of the marine vessel to a magnitude which is greater than the distance D.

Figure 5:
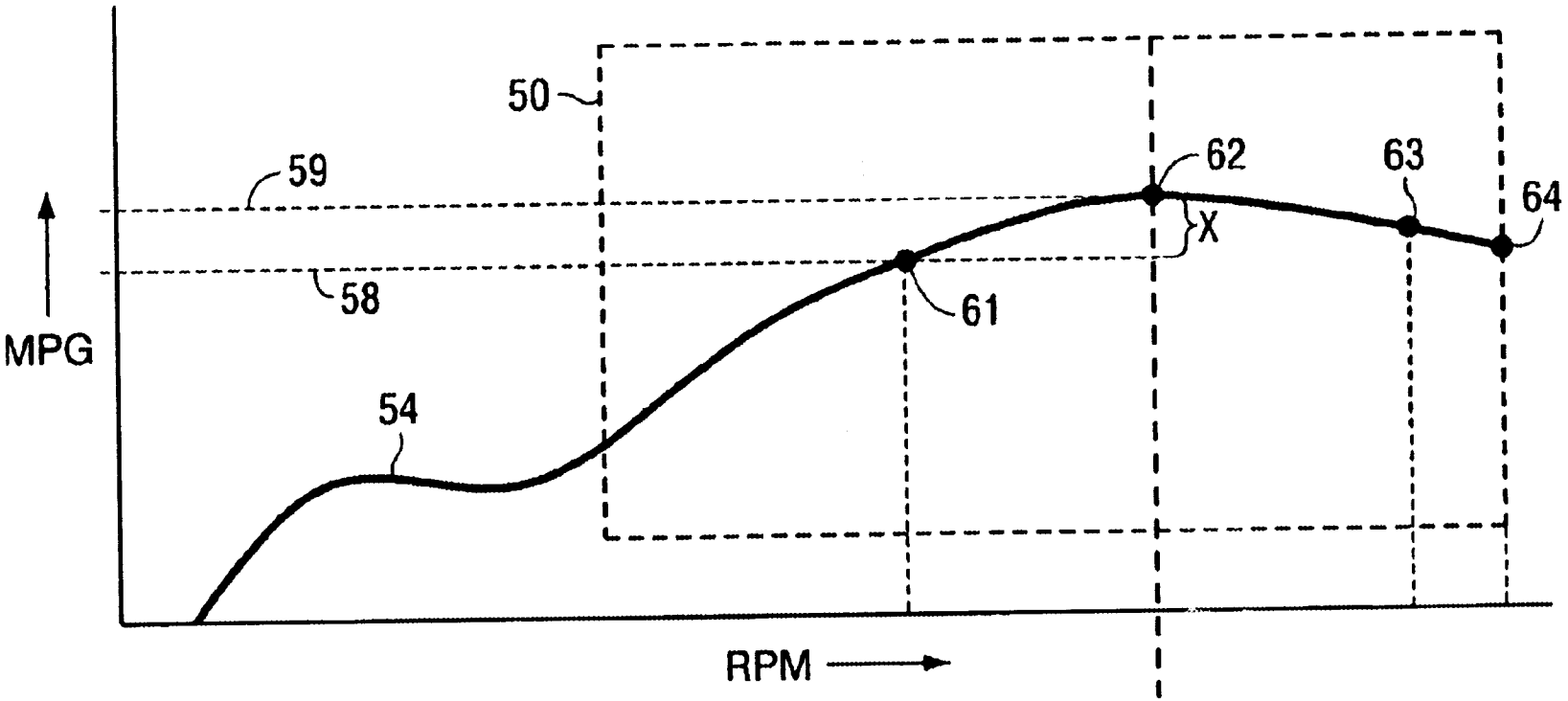
FIG. 5 is a graphical representation showing a fuel efficiency curve of a marine vessel for a particular load.

FIG. 5 is a graphical representation of the fuel efficiency, measured in miles per gallon (MPG), of a marine vessel as a function of the engine speed measured in revolutions per minute (RPM). The dashed box 50 represents the region of engine speed that is related to the marine vessel operating on plane. In a preferred embodiment of the present invention, all determinations and calculations are made with the assumption that the marine vessel remains on plane at all times. Since the efficiencies of the marine vessel are significantly lower when operated at vessel speeds and engine speeds below planning speed, it is assumed in a preferred embodiment of the present invention that no advantage can be obtained by reducing the engine speed below those enclosed within the dashed line box 50.

With continued reference FIG. 5, it should be understood that the fuel efficiency, measured in miles per gallon (MPG), illustrated in FIG. 5 is also a function of vessel speed which is, in turn, a function of engine speed (RPM). The relation between vessel speed and engine speed can also vary as a function of load. As an example, if additional weight is added to the marine vessel, the vessel speed will be less, for any given engine speed, than when operated without the additional load. In addition, when the marine vessel is operated in a direction into a headwind, the vessel speed is also affected. Generally speaking, the magnitude of load on the engine can affect the relationship between engine speed (RPM) and vessel speed (MPH). As a result, a family of curves can be determined for a particular vessel to describe its fuel efficiency profile as a function of engine speed. In FIG. 5, a single curve 54 is illustrated, but it should be understood that a plurality of curves could be stored in the memory of the engine control module 36 to accommodate changes in load on the vessel. At any particular time, the engine control module 36 can determine which of those load profiles is most appropriate for use in determining the best engine speed to result in a range 25 of the marine vessel to increase the range to a value greater than the distance D necessary to return to the desired waypoint 11.

In order to describe the operation of the present invention, it will be assumed that the marine vessel is operating at an engine speed (RPM) represented by point 61 in FIG. 5. That engine speed results in a fuel efficiency that is represented by dashed line 58. If the range of the marine vessel, when it is at waypoint 14, is determined to be less than distance D, it is insufficient to allow the vessel to return to the desired waypoint 11. Since the data represented in FIG. 5 can be stored in the memory of the microprocessor of the engine control module 36, the present invention can examine the various optional engine speeds available and determine whether or not the fuel efficiency of the marine vessel can be improved enough so that the range is increased above the magnitude of distance D. In FIG. 5, it can be seen that if the engine speed is increased to that represented by point 62, a fuel efficiency improvement identified as X in FIG. 5 can be achieved. Even though the increase in engine speed from point 61 to point 62 may increase the fuel usage in terms of its fuel rate per unit of time (GPM), the accompanying increase in vessel speed reduces the time necessary to return to the desired waypoint 11. This relationship is represented by curve 54 in FIG. 5. The range can be recalculated based on the fuel efficiency at point 62 to determine whether or not a change in engine speed to point 62 will allow the marine vessel to return to the desired waypoint 11.

In order to show that either an increase, as described above, or decrease in the engine speed may achieve an improvement in vessel range sufficient to achieve the desired waypoint 11, point 63 is illustrated in FIG. 5. If the vessel was operating at point 63, the present invention would determine that a decrease in engine speed to point 62 would achieve an improvement in fuel efficiency that could cause the theoretical range to be increased above the magnitude of distance D. Depending on the engine speed at which the marine vessel is operating, either an increase or a decrease may provide sufficient improvement in vessel range to achieve the desired waypoint 11.

Point 64 is illustrated in FIG. 5 show a wide open throttle (WOT) point of engine speed. It can be helpful if the present invention also calculates the effect on range if the operator operates the marine vessel at wide open throttle. Although not the case in the engine such as represented in FIG. 5, there are certain situations in which wide open throttle (WOT) operation is the best way to achieve a return to the desired waypoint. In other words, wide open throttle operation can be the most fuel efficient choice with certain marine vessels.

The calculations relating to the determinations described above in conjunction with FIG. 5 are generally straightforward. When the operator invokes the operation of the present invention, the microprocessor of the engine control module 36 can take immediate measurements relating to the gallons of fuel remaining in the fuel tank 37, the instantaneous engine speed (RPM), the speed over ground (SOG) of the vessel and the resulting fuel efficiency (MPG). It should be understood that the fuel efficiency can be stored as gallons per hour (GPH) for each selected engine speed (RPM) and then converted to miles per gallon as a function of the current vessel speed. The specific calculations used to determine the relevant variables are not limiting to the present invention. One exemplary method for calculating these intermediate variables could include a determination of remaining time determined by the fuel in the fuel tank and the rate of fuel usage. In other words, the gallons in the fuel tank divided by the gallons per hour of fuel usage yields the time until the fuel is completely used. This time, multiplied by the vessel speed (SOG) will yield a theoretical range for the marine vessel. That range, measured in miles, can be compared to the distance D. Similarly, a time can be calculated which represents the time that the marine vessel will take to reach its desired waypoint 11 at the current operating speed. By dividing the distance D by the velocity (SOG) the time to waypoint can be determined. Naturally, if the time to the waypoint is greater then the time to the "no remaining fuel" condition, some remedial action must be taken.

In a preferred embodiment of the present invention, the processes performed by the present invention are activated by a request from the operator of the marine vessel. When the operator of the marine vessel invokes the present invention, the various determinations and calculations described above are preformed. An alternate embodiment of the present invention could operate the present invention continuously at all times, during which the theoretical range is continually calculated as a function of changing engine speed and movement of the marine vessel. The distance D would also be continuously calculated as a function of the desired waypoint 11 and the current position 14 of the marine vessel. If the distance D increases to a preselected percentage (e.g. 90%) of the theoretical range at any time, an alarm message could be provided to the operator of the marine vessel that the vessel was approaching a distance that was approximately equal to the range of the vessel and that return to the desired waypoint 11 could be problematic if corrective action is not take.

The operation of the present invention, as described above, provided suggested corrections to the engine speed to assist the operator of the marine vessel in returning to the desired waypoint 11. It is recognized that certain conditions may arise when that return to the desired waypoint 11 is no longer possible. With reference to FIG. 1, a condition could arise where the range of the marine vessel, when at location 14, is insufficient to return to the desired waypoint 11. At that point, the present invention would notify the operator of this condition and would suggest to the operator of the marine vessel that an alternate waypoint, such as waypoint 15, be selected.

An alternative embodiment of the present invention would allow the operator of the marine vessel to give actual control of the engine to the present invention when the system is invoked by the operator. In other words, rather then have the present invention provide suggested engine speeds to the operator, with the operator actually changing the engine speed manually, the present invention could be given control of the engine so that it continuously maintains an engine speed that provides sufficient fuel economy to return the marine vessel to the desired waypoint 11. Under this mode of operation, the present invention could either select a maximum fuel efficiency, such as point 62 in FIG.

5, or determine the highest engine speed available that provides a sufficient fuel efficiency to return the marine vessel back to the desired waypoint 11. In other words, when invoked by the operator of the marine vessel, the present invention may determine that, even though the distance D is close to the calculated range of the marine vessel, the marine vessel can return to the desired waypoint 11 even when operated at wide open throttle (WOT) as represented by point 64 in FIG. 5. In view of the fact that the operator's invocation of the present invention typically represents an emergency situation or at least one where there is some concern of the ability to return to the desired waypoint 11, the present invention may decide to return from the current location 14 to the desired waypoint 11 at maximum allowable speed. This would typically be associated with wide open throttle (WOT) even though point 64 in FIG. 5 does not necessarily represent the highest fuel efficiency type of operation. The highest fuel efficiency would occur at point 62.

It should be understood that improvement in fuel efficiency by the present invention can be achieved by either increasing or decreasing the engine speed, depending on the engine speed at the time when the present invention is invoked by the operator of the marine vessel. It should also be understood that various specific calculations, mathematical techniques, and data storage processes can be used to implement the present invention. Optional embodiments of the present invention include a system that advises the operator to manually change the operating speed of the engine to speeds identified by the present invention. It also includes embodiments in which direct control is yielded to the present invention by the operator and the present invention, operating as a program in the microprocessor of the engine control module, takes direct control of the engine operating speed. An embodiment of the present invention also operates as a monitor to continuously compare theoretical ranges of the marine vessel to its current position and desired waypoint. In the event that the distance between the current position and the desired waypoint becomes great than a preselected percentage of the range, the operator of the marine vessel is notified to begin the return trip as soon as possible.

The operating speed of the engine is typically measured in revolutions per minute, the velocity of the marine vessel is typically measured in distance per unit of time (e.g. miles per hour), and the remaining fuel is typically measured in gallons. The fuel efficiency can be stored in terms of gallons per hour at particular engine speeds and converted to miles per gallon as a function of vessel speed, as represented in FIG. 5. The location of the marine vessel at its various waypoints can be determined by a global positioning system (GPS). The velocity of the marine vessel can also be determined by the global positioning system, although the use of a paddle wheel speedometer or pitot tube can also be used.

Figure 6:
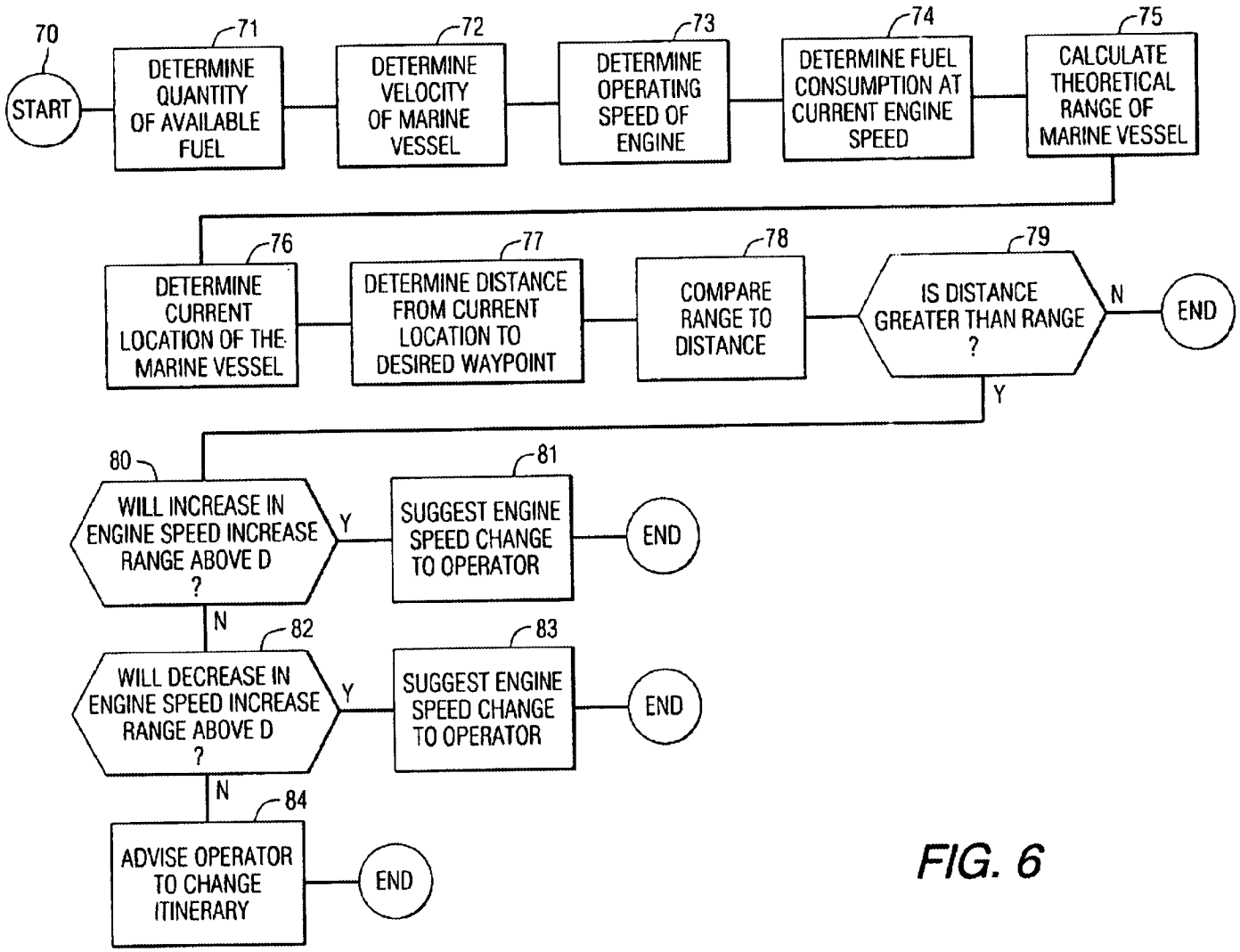
FIG. 6 is a flowchart showing the basic steps of the present invention.

FIG. 6 is a simplified flowchart showing the basic steps of the present invention. It should be understood that several embodiments of the present invention are possible, as described above. The embodiment represented in FIG. 6 is the embodiment in which various suggestions are provided to the operator of the marine vessel and no direct action is taken by the present invention to control the operation of the engine. In addition, the embodiment represented in FIG. 6 does not provide the continual monitoring of range and distance to alert the operator when the distance approaches the magnitude of a preselected percentage of the calculated range.

In FIG. 6, invocation of the present invention causes the program to begin at the start point 70. At functional block 71 the quantity of available fuel is determined, typically by a depth sensor in the fuel tank of the marine vessel. The velocity of the marine vessel is determined at functional block 72, either by the GPS system or by a speedometer that uses a paddle wheel or pitot tube. At functional block 73, the instantaneous operating speed of the engine is determined, typically by a tachometer. At functional block 74, the fuel consumption rate is determined. As described above, this can be a variable that is continuously monitored by the microprocessor of the engine control module, particularly when the engine is a fuel injected engine. A theoretical range is calculated at functional block 75. The theoretical range is determined as a function of the available fuel in the fuel tank, the vessel speed, and the fuel usage rate. The current location of the marine vessel is determined at functional block 76, typically by a GPS system. The distance from the current location to a desired waypoint is determined at functional block 77. The range and distance are compared to each other at functional block 78 to determine whether or not the distance is greater than the range. At functional block 79, if the distance is not greater then the range, the program ends because no apparent problem exists with regard to the ability of the marine vessel to return back to its desired waypoint. However, if it is determined that the distance is greater then the range at functional block 79, the present invention examines stored information relating to the fuel efficiency of the marine vessel as a function of engine speed, as described above in conjunction with FIG. 5, and determines whether or not an increase in engine speed will increase the range above the distance magnitude. This is described in functional block 80. If an increase in engine speed will achieve the desired result, this increase is suggested to the operator of the marine vessel at functional block 81. If the increase in engine speed will not achieve the desired results, the present invention determines whether or not a decrease in engine speed will increase the range above the distance, as shown at functional block 82. If this will achieve the purpose, the changes suggested to the operator at functional block 83. If neither an increase or a decrease in engine speed will improve the range of the marine vessel to a magnitude greater than the distance between the current location and the desired waypoint, the operator is advised that a change in itinerary will be necessary. This is described at functional block 84. In other words, the operator is informed that insufficient fuel is available in the fuel tank of the marine vessel to be able to return to the desired waypoint. Naturally, the planned itinerary must be changed to allow the marine vessel to return to an alternate port to receive additional fuel.

Although FIG. 6 is intended to illustrate a mode of the present invention in which an operator of the vessel is requested or instructed to manually change speeds, it should be understood that the microprocessor can directly and automatically change the speed without involvement of the operator. These are two alternative embodiments of the present invention.

Although the present invention has been described in particular detail and illustrated to show a preferred embodiment, it should be understood that alternative embodiments are also within its scope.

We claim:

1. A method for controlling the operation of a marine vessel, comprising the steps of:

determining a quantity of available fuel of said marine vessel;

determining a velocity of said marine vessel;

determining a current operating speed of an engine of said marine vessel;

determining a rate of fuel consumption of said marine vessel;

determining a range of said marine vessel as a function of said quantity of available fuel and said rate of fuel consumption;

determining a current location of said marine vessel;

selecting a desired location of said marine vessel;

determining a distance between said current location and said desired location;

comparing said range to said distance; and determining, in situations where said distance is greater than said range, if an increase of said current operating speed of said engine will increase said range to a magnitude which is greater than said distance.

2. The method of claim 1, further comprising:

informing the operator of said marine vessel that said increase of said current operating speed of said engine will increase said range to said magnitude which is greater than said distance.

3. The method of claim 1, further comprising:

increasing said current operating speed of said engine by an amount that will increase said range to said magnitude which is greater than said distance.

4. The method of claim 1, further comprising:

determining, in situations where said distance is greater than said range, if a decrease of said current operating speed of said engine will increase said range to a magnitude which is greater than said distance.

5. The method of claim 4, further comprising:

informing the operator of said marine vessel that said decrease of said current operating speed of said engine will increase said range to said magnitude which is greater than said distance.

6. The method of claim 4, further comprising:

decreasing said current operating speed of said engine by an amount that will increase said range to said magnitude which is greater than said distance.

7. The method of claim 1, wherein:

said current operating speed of said engine is measured in revolutions per minute.

8. The method of claim 1, wherein:

said velocity is measured in distance per unit of time.

9. The method of claim 1, further comprising:

providing an annunciated message, when said range is less than said distance, that said range is less than said distance.

10. The method of claim 1, further comprising:

monitoring the magnitudes of said distance and said range; and providing an alarm notification when said magnitude of said distance is greater than a preselected percentage of said magnitude of said range.

11. The method of claim 1, wherein:

said current location is determined by a global positioning system.

12. The method of claim 1, wherein:

said velocity is determined by a global positioning system.

13. The method of claim 1, wherein:

said velocity is determined by a paddle wheel sensor.

14. The method of claim 1, wherein:

said current operating speed of said engine is determined by a tachometer.

15. A method for controlling the operation of a marine vessel, comprising the steps of:

determining a quantity of available fuel of said marine vessel;

determining a velocity of said marine vessel;

determining a current operating speed of an engine of said marine vessel;

determining a rate of fuel consumption of said marine vessel;

determining a range of said marine vessel as a function of said quantity of available fuel and said rate of fuel consumption;

determining a current location of said marine vessel;

selecting a desired location of said marine vessel;

determining a distance between said current location and said desired location;

determining if said range is less than said distance; and determining, in situations where said distance is greater than said range, if a change of said current operating speed of said engine will increase said range to a magnitude which is greater than said distance.

16. The method of claim 15, further comprising:

informing the operator of said marine vessel that said change of said current operating speed of said engine will increase said range to said magnitude which is greater than said distance.

17. The method of claim 15, further comprising:

changing said current operating speed of said engine by an amount that will increase said range to said magnitude which is greater than said distance.

18. The method of claim 15, further comprising:

providing an annunciated message, when said range is less than said distance, that said range is less than said distance.

19. The method of claim 15, further comprising:

monitoring the magnitudes of said distance and said range; and providing an alarm notification when said magnitude of said distance is greater than a preselected percentage of said magnitude of said range.

20. A method for controlling the operation of a marine vessel, comprising the steps of:

determining a quantity of available fuel of said marine vessel;

determining a velocity of said marine vessel;

determining a current operating speed of an engine of said marine vessel;

determining a rate of fuel consumption of said marine vessel;

determining a range of said marine vessel as a function of said quantity of available fuel and said rate of fuel consumption;

determining a current location of said marine vessel;

selecting a desired location of said marine vessel;

determining a distance between said current location and said desired location;

determining if said range is less than said distance;

determining, in situations where said distance is greater than said range, if a change of said current operating speed of said engine will increase said range to a magnitude which is greater than said distance; and informing the operator of said marine vessel that said change of said current operating speed of said engine will increase said range to said magnitude which is greater than said distance.

21. The method of claim 20, further comprising:

providing an annunciated message, when said range is less than said distance, that said range is less than said distance.

22. The method of claim 20, further comprising:

monitoring the magnitudes of said distance and said range; and providing an alarm notification when said magnitude of said distance is greater than a preselected percentage of said magnitude of said range.

23. The method of claim 20, further comprising:

changing said current operating speed of said engine by an amount that will increase said range to said magnitude which is greater than said distance.

* * * * *